United States Patent [19]

Pulskamp

[11] Patent Number: 4,624,452

[45] Date of Patent: Nov. 25, 1986

[54] BOARD INSERTER FOR PRINTING PRESS

[76] Inventor: Nicholas R. Pulskamp, 1616 Bushnell Ave., South Pasadena, Calif. 91030

[21] Appl. No.: 766,494

[22] Filed: Aug. 19, 1985

[51] Int. Cl.[4] ..... B65H 45/22

[52] U.S. Cl. ..... 270/95; 271/229; 271/258; 209/652

[58] Field of Search ..... 270/95, 60, 58; 271/188–189, 314, 207, 209, 213–214, 258, 229; 209/65–66, 608, 641, 652, 3.3; 101/2

[56] References Cited

U.S. PATENT DOCUMENTS

| | | | |
|---|---|---|---|
| 1,642,746 | 9/1927 | Renz | 270/95 |
| 2,619,883 | 12/1952 | Andrew | 270/95 |
| 2,855,833 | 10/1958 | Rugg et al. | 270/95 |
| 2,927,512 | 3/1960 | Lambert | 270/95 |
| 3,458,186 | 7/1969 | Schmidt | 270/95 |
| 3,466,983 | 9/1969 | Meyer-Jagenberg | 270/95 |
| 3,555,978 | 1/1971 | McCool | 270/95 |
| 3,966,196 | 6/1976 | Simeth | 271/189 |

*Primary Examiner*—E. H. Eickholt

*Attorney, Agent, or Firm*—Christie, Parker & Hale

[57] ABSTRACT

A board inserter for use with a printing press provides for the automatic insertion of paper boards or the like between predetermined numbers of printed sheets as they emerge from the printing press. The board inserter is used to make note pads or the like in which stacks of paper are attached to a heavier paper board backing.

6 Claims, 3 Drawing Figures

BOARD INSERTER FOR PRINTING PRESS

FIELD OF THE INVENTION

This invention relates to an attachment for printing presses, and more particularly, to a mechanism for inserting paper boards at spaced intervals in a stack of printed sheets.

BACKGROUND OF THE INVENTION

Note pads in which the individual sheets of the pad have printed material impressed on each sheet are commonly manufactured by inserting the heavy paper board backing between groups of the printed sheets as they emerge from the printing press. As the printed sheets emerge from the press, they fall onto a stack individually sheet-by-sheet. In manufacturing note pads, it has been the practice to count the desired number of sheets per pad as the sheets emerge from the press, and then insert a board into the stack following the correct number of sheets. When the stack of sheets is removed from the press, the stack is divided at predetermined intervals by the backing boards. Each backing board is then cemented at one edge to the overlying groups of sheets to form each pad.

SUMMARY OF THE INVENTION

The present invention is directed to apparatus for automatically inserting paper boards into a stack of printed sheets as the sheets emerge from a printing press. Counting means senses each sheet as it emerges from the printing press and drops onto the stack. A board feeder mechanism removes one paper board at a time from a stack and ejects the board into the path of the falling sheets as they emerge from the press. A retractable retaining arm is moved into and out of the path of the falling sheets in synchronism with the ejection of each board to maintain momentarily a gap between adjacent sheets into which the board is inserted.

BRIEF DESCRIPTION OF THE DRAWINGS

For a more complete understanding of the invention, reference should be made to the accompanying drawings wherein.

DETAILED DESCRIPTION

Figure 1:
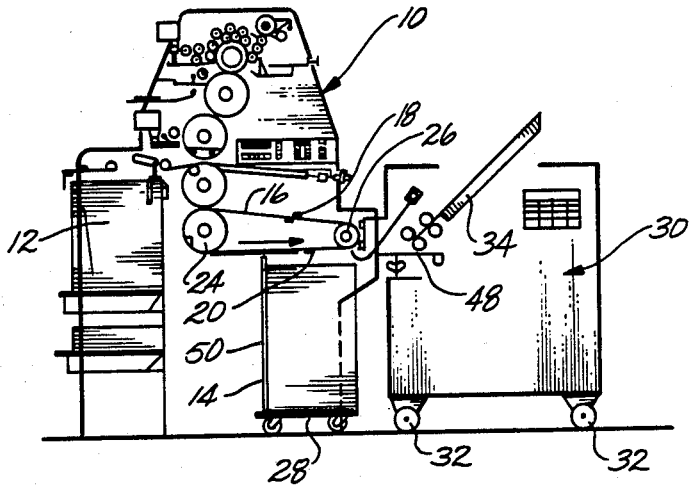
FIG. 1 is a cross-sectional view of the invention in combination with a standard printing press.

Referring to FIG. 1 in detail, the 10 indicates generally a standard printer of a type having a chain delivery system. Presses of this type are sold under trade names such as Multilith, Heidlberg and A. B. Dick, for example. The press receives one sheet of paper at a time from a stack 12. The sheet is run through the press, printed and delivered to the top of a stack 14. The press is provided with a chain delivery system which comprises a pair of spaced chains, one of which is indicated at 16 with clamping elements, such as indicated at 18 and 20, bridging the two chains and clamping one edge of a sheet as it comes off the press. The chains are rotated about a pair of sprockets 24 and 26 in a direction to move the sheet of paper across the top of the stack 14 where it is released by opening the clamping elements and allowed to fall by gravity onto the top of the stack.

In the past, it has been the practice to manually insert a paper board on top of the stack following a predetermined number of sheets being delivered to the stack 14. Stack 14 is supported on a dolly 28 enabling the stack to be wheeled away from the press. With the boards inserted at spaced intervals of 25 or more sheets in the stack, the stack can then be divided into separate units, each unit containing a single board. The unit of one board in a group of sheets can then be formed into a note pad by applying cement along one edge in conventional manner.

The present invention provides an improved apparatus for automatically inserting the boards at intervals in the stack 14. The board inserting mechanism of the present invention is indicated generally at 30. It is preferably supported on casters 32 allowing it to be rolled up to the front of the printing press 10. As shown in more detail in FIGS. 2 and 3, the feeder mechanism 30 includes a board loading table 34 on which the boards are stacked. The loader table is supported in an incline position by a frame 36. The table includes a pair of adjustable guides 38 and 40 which engage the opposite edges of the stack of boards.

The feeder mechanism, which operates in conventional fashion by removing one board at a time from the stack, includes a retaining roll 41 and a feed roll 42. When the feeder mechanism is actuated, it rotates the feed roll 42, causing a board to be fed past the retaining roll into contact with a pair of rotating thrust rollers 44 and 46. The thrust rollers feed the board against an adjustable deflection table 48 at sufficient velocity to propel the board out of the feeder mechanism into position above the stack 14 formed by the printing press 10. Stop guides 50 at the rear of the stack 14 position the boards in alignment with the stack. The angle of the deflection table 48 is made adjustable by a suitable set of thumb screws 52 which adjust the deflection table 48 about a hinge support 54.

Figure 2:
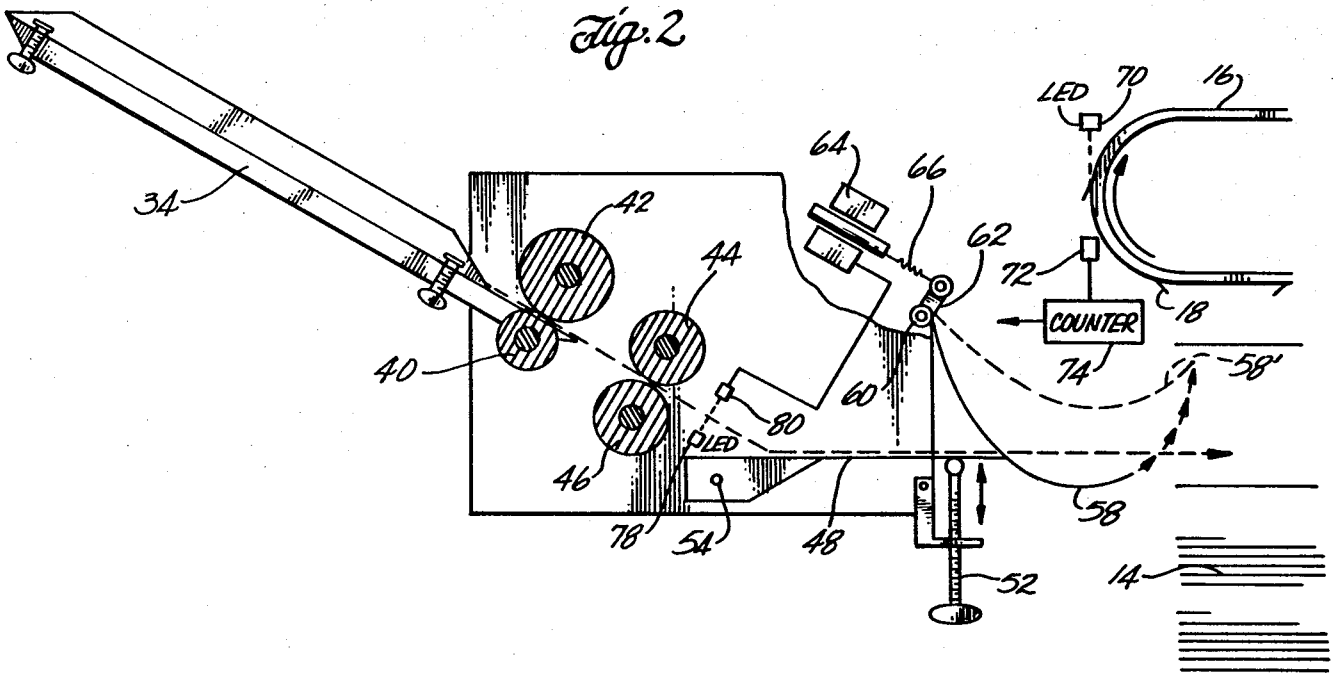
FIG. 2 is a simplified sectional view of the board feeder mechanism of the present invention.
Figure 3:
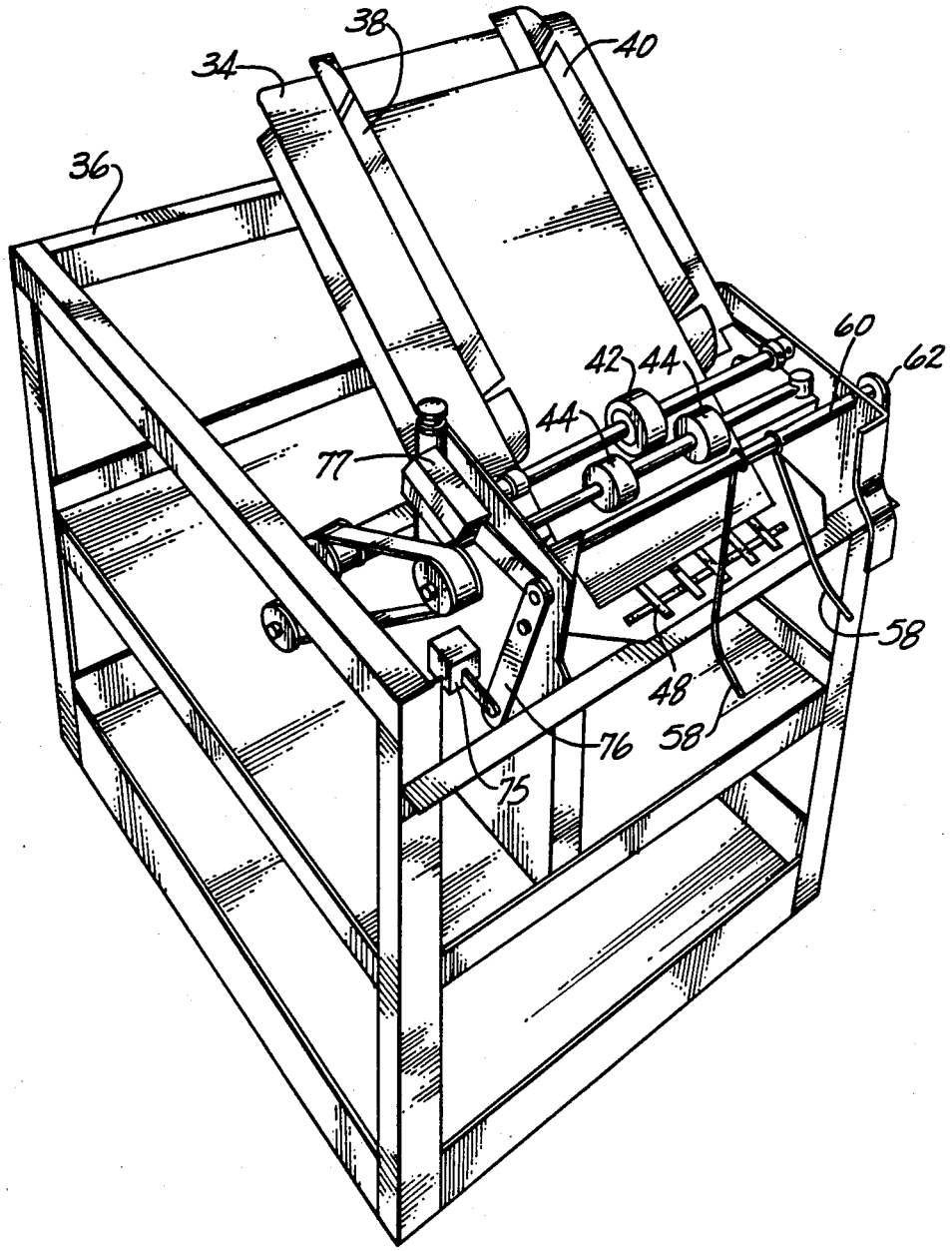
FIG. 3 is a perspective view of the board feeder mechanism of the present invention.

In order to prevent jamming or interference between the board as it is inserted and a falling sheet from the press, it is desirable to ensure an adequate gap between successive sheets being dropped on the stack 14 from the press. This is accomplished as seen in FIG. 2 by a pair of stiff wire spring fingers 58 which are secured to a rotatably supported rod 60. The other end of the rod 60 is connected to a crank arm 62. The crank arm 62 in turn is connected to a solenoid 64 through a tension spring 66. When the solenoid 64 is energized, the spring fingers 58 are rotated upwardly to the position indicated at 58'. As the spring fingers are rotated, the outer ends move in an arc which intersects the vertical plane defined by the edges of the falling printed sheets from the press. Thus the outer ends of the spring fingers 58 rotate into position below the bottom surface of the upper falling sheet, ensuring that a gap is maintained into which the board is inserted as it is thrust into the path of the falling sheets by the action of the thrust rollers 44 and 46.

In operation, as the chain delivery system 16 of the press brings each sheet into position and releases it onto the top of the stack 14, the sheet clamping unit on the chain drive interrupts a beam of light between a light emitting diode 70 and a light sensor 72. The output of the sensor 72 actuates a counter 74. Thus the counter 74 provides a count of the number of sheets released onto the stack by the chain delivery system of the press. The counter can be preset to any count condition and when it counts a corresponding number of sheets, the counter provides an output pulse which actuates a solenoid 77 mounted on the side of the frame of the feeder assembly. The solenoid, through a suitable linkage arm 74, operates a rack and pinion drive 76 to rotate the feed roller 42. This moves the top board on the board stack into contact with the continuously rotating thrust rollers 44 and 46, causing the board to be ejected into the stack of printed sheets being formed by the printing press 10. As the board is ejected through the thrust rollers, it interrupts a light beam from a light emitting diode 78, actuating a sensor 80 which in turn causes the fingers 58 to rotate into the path of the falling printed sheets.

From the above description, it will be seen that a succession of paper boards can be inserted between predetermined numbers of individual printed sheets as they emerge in a stack from a printing press. The boards enable the stack to be divided and formed into note pads or the like in which each board forms a backing for a group of printed sheets. The number of sheets per pad can be set automatically by a counter.

What is claimed is:

1. Apparatus for inserting paper boards between stacks of paper sheets as the sheets fall individually one at a time onto a stack, comprising:

feeder means for removing and feeding one board at a time from a stack of boards;

means directing each board as it is fed from the stack into the path of said falling sheets;

means synchronizing the feeding of a board by said feeder means with the falling of said papr sheets such that a board is fed between two successive falling sheets;

said synchronizing means comprising counter means for counting the paper sheets, means activating the feeder means in response to the counter means when a predetermined number of paper sheets have fallen, retractable restraining means; means moving said restraining means into and out of the path of said falling paper sheets, and means activating the moving means with each cycle of the feeder means to move the restraining means into the path of the falling sheets, whereby the fall of a sheet is momentarily interrupted while a board is fed into the path of the falling sheet;

the restraining means including a pair of spring fingers movable along a path extending upwardly into engagement with a falling sheet adjacent one edge of the sheet.

2. Apparatus of claim 1 wherein the feeder means includes a pair of thrust rollers engaging a board and thrusting the board out with sufficient velocity to carry the board into alignment with the falling paper sheets.

3. Apparatus of claim 1 wherein the feeder means includes a pair of thrust rollers engaging a board and thrusting the board out with sufficient velocity to carry the board into alignment with the falling paper sheets.

4. Apparatus of claim 1 wherein the spring fingers are secured at one end to a shaft, the moving means rotating the shaft to rotate the outer ends of the fingers into the path of a falling sheet.

5. Apparatus of claim 2 further including an adjustable deflection plate for guiding the board as it emerges from the thrust rollers.

6. Apparatus for inserting paper boards between stacks of paper sheets as the sheets fall individually one at a time onto a stack, comprising:

feeder means positioned to one side of the stack of papers for propelling one board at a time into the path of the falling sheets in a direction substantially parallel to the top of the stack; stop means aligned with the stack for engaging each propelled baord to position the board with the stack; means synchronizing the propelling of a board by said feeder means with the falling of said paper sheets such that a board is fed between two successive sheets, said synchronizing means comprising restraining means including at least one movable arm positioned adjacent one margin of the falling paper sheets nearest the feeder means, means moving one end of the arm into vertically overlapping position with said one margin of a fallng sheet at a vertical position slightly above the path of a propelled board, and means activating said moving means in synchronism with the feeder means to position the arm momentarily in said overlapping position with the release of each propelled board.

* * * * *